United States Patent [19]

Wild et al.

[11] Patent Number: 4,609,227

[45] Date of Patent: Sep. 2, 1986

[54] CUTTING-TOOL MOUNTING FOR ROTARY EXCAVATING HEAD

[75] Inventors: Walter Wild, Dinslaken; Albert Peters, Giesenender Kirchweg 18, 4005 Meerbusch 2, both of Fed. Rep. of Germany

[73] Assignees: Ruhrkohle AG, Essen; Albert Peters, Meerbusch, both of Fed. Rep. of Germany

[21] Appl. No.: 550,921

[22] Filed: Nov. 10, 1983

[30] Foreign Application Priority Data

Nov. 13, 1982 [DE] Fed. Rep. of Germany ..... 3242144
May 11, 1983 [DE] Fed. Rep. of Germany ..... 3317145
Nov. 2, 1983 [DE] Fed. Rep. of Germany ..... 3339558

[51] Int. Cl.[4] ..... E21B 10/62
[52] U.S. Cl. ..... 299/93; 299/91
[58] Field of Search ..... 299/93, 91, 92; 37/142 R; 175/413; 407/37–39, 41, 45, 49, 81–83, 84, 95

[56] References Cited

U.S. PATENT DOCUMENTS 2,144,986 1/1939 Miller ..... 407/38
2,272,692 2/1942 Dartnell ..... 299/93
2,458,946 1/1949 Johnston ..... 299/93
2,972,802 2/1961 Stein ..... 407/95 X
3,882,582 5/1975 Williams ..... 407/41 X
4,057,294 11/1977 Krekeler ..... 299/93
4,305,440 12/1981 Lacasse ..... 407/45 X

FOREIGN PATENT DOCUMENTS 7823740 11/1978 Fed. Rep. of Germany .
8116945 9/1982 Fed. Rep. of Germany .
702898 1/1954 United Kingdom ..... 407/41

*Primary Examiner*—Stephen J. Novosad
*Assistant Examiner*—Michael A. Goodwin
*Attorney, Agent, or Firm*—Karl F. Ross; Herbert Dubno

[57] ABSTRACT

A cutting tool or pick on a rotary excavating head has a substantially flat body with leading and trailing flanks, one of these flanks having an arcuate recess or projection matingly engaged by a complementarily curved formation on an adjacent wall of a pocket of a tool holder defining therewith a rotary joint about which the body of the pick is swingable upon insertion of its shank into the pocket. A screw clamp inside the pocket wedges the pick firmly in a position which in one embodiment is adjustable by the provision of a toothed and an indented surface of the rotary joint enabling selective interfitting. The pick may be further braced by one or more additional screws threaded into it and bearing upon other pocket walls.

12 Claims, 18 Drawing Figures

CUTTING-TOOL MOUNTING FOR ROTARY EXCAVATING HEAD

FIELD OF THE INVENTION

Our present invention relates to a rotary excavating head, e.g. as used in coal mining, having tool holders for the support of respective cutting tools or picks peripherally distributed thereon for the purpose of chipping away at a mine face as the excavating head advances along its axis of rotation.

BACKGROUND OF THE INVENTION

In order to facilitate the replacement of worn or broken picks, each pick must be removably fitted into a receiving pocket of the associated holder within which it is locked in position by suitable fastening means. The removal of a pick from its pocket is sometimes made difficult by the settling of comminuted matter, such as coal or rock particles, in the narrow clearances necessarily present between the inserted part of the pick—referred to hereinafter as its shank—and the adjacent walls of the receiving pocket. Such penetration of solid particles will occur even if, as is customary, the excavating head is provided with nozzles through which water is emitted in order to precipitate the evolving dust. Thus, forces exerted upon the tool shank not only during cutting but also during extraction of the pick from its holder may deform the holder itself unless care is taken to insure an optimum mode of seating the shank in its pocket and holding it in position.

German utility model No. 78 23 740 discloses a holder for a pick with an outline in the form of an equilateral triangle allowing any one of its three corners to be used as a working edge of its projecting tip while another corner forms part of a shank projecting into the holder pocket. The shank is held in place by a bolt passing through frustoconical sleeves which converge toward each other and are clamped between the bolt head and a nut, the sleeves bearing upon two trapezoidal wedge pieces respectively lying against a trailing flank of the pick and a confronting rear wall of the pocket. The retaining effect of such a clamp is somewhat uncertain on account of the large angle of divergence (60°) of the leading and trailing flanks of the shank and in view of the absence of any positive-acting abutment.

Another arrangement for releasably retaining a pick in an associated tool holder is shown in German utility model No. 81 16 945.0. According to that arrangement, the trailing flank of the tool shank has a spur underreaching a shoulder at the back of the pocket while its leading flank has a concave surface separated by an arcuate gap from a convex surface of a transverse web spanning the sidewalls of the pocket; the two surfaces are curved about different axes so that the gap converges. A similarly converging arcuate wedge piece is forced into the gap and terminates in a bifurcation whose prongs have ends bent around the web to hold the wedge piece in place. Since an extraction of the pick requires an unbending of the prong ends which upon a subsequent rebending would have lost some of their holding strength, not only the pick but also the wedge piece will have to be replaced; also, the bending and unbending operations are difficult to perform underground and the need for having spare wedge pieces available is an inconvenience.

Aside from the necessity of replacing worn picks, it is sometimes desirable to change the angle of attack of a still usable pick which requires a repositioning thereof in its pocket. Such a repositioning is not possible with the arrangement last described; while the triangular pick of the first-mentioned German utility model has three possible positions, the angle of attack remains the same in all instances.

OBJECTS OF THE INVENTION

The general object of our present invention is to provide improved means for seating and retaining the shank of a pick in the pocket of an associated tool holder with minimization of the problems of insertion and extraction.

A more particular object is to provide means in such a tool holder for enabling the positioning of the pick at slightly different angles of attack.

SUMMARY OF THE INVENTION

In accordance with our present invention, the shank of a pick with leading and trailing flanks (as viewed in the direction of rotation of an excavating head carrying the tool holder) and with two generally flat sides is received in a pocket having two narrower walls confronting its flanks and two wider walls confronting its sides, one of the flanks and the confronting wall being provided with mutually complementary arcuate formations defining a rotary joint that extends over an arc between 90° and 180° and is centered on a pivotal axis perpendicular to the shank sides near the level of the open end of the pocket through which the tip of the pick protrudes. The two narrower walls of the pocket are spaced apart sufficiently to let the shank swing relatively to the tool holder about that pivotal axis while a surface area of the shank remote from the pivotal axis is engaged by screw-threaded counterbearing means in the pocket, accessible from outside the tool holder, to lock the shank in an inserted position.

According to a more particular feature of our invention, the counterbearing means comprises a clamping screw with a bolt head engageable by an external implement and a nut coacting with the remote surface area of the shank, rather than with an interposed wedge piece of the type used in the aforementioned German utility model No. 78 23 740. The clamping screw may also pass through a presure sleeve, located between the bolt head and the nut, for exerting additional stress upon the remote surface area while serving as an abutment for the bolt head. Alternatively, the clamping screw may bear endwise upon a pocket boundary, e.g. upon a step of the excavating head forming such a boundary.

Pursuant to another advantageous feature of our invention, the arcuate formations referred to may be complementarily toothed and indented for enabling a selective interfitting in a plurality of different relative angular positions. Such different positions can also be selectively established with the aid of similar mutually complementary indentations of the pressure sleeve and the remote surface area engaged thereby.

Moreover, the counterbearing means according to our invention may further comprise bracing means in the form of one or more ancillary screws engaging a threaded bore of the shank and bearing endwise upon a boundary of the pocket.

BRIEF DESCRIPTION OF THE DRAWING

The above and other features of our invention will now be described in detail with reference to the accompanying drawing in which.

SPECIFIC DESCRIPTION

Figure 1:
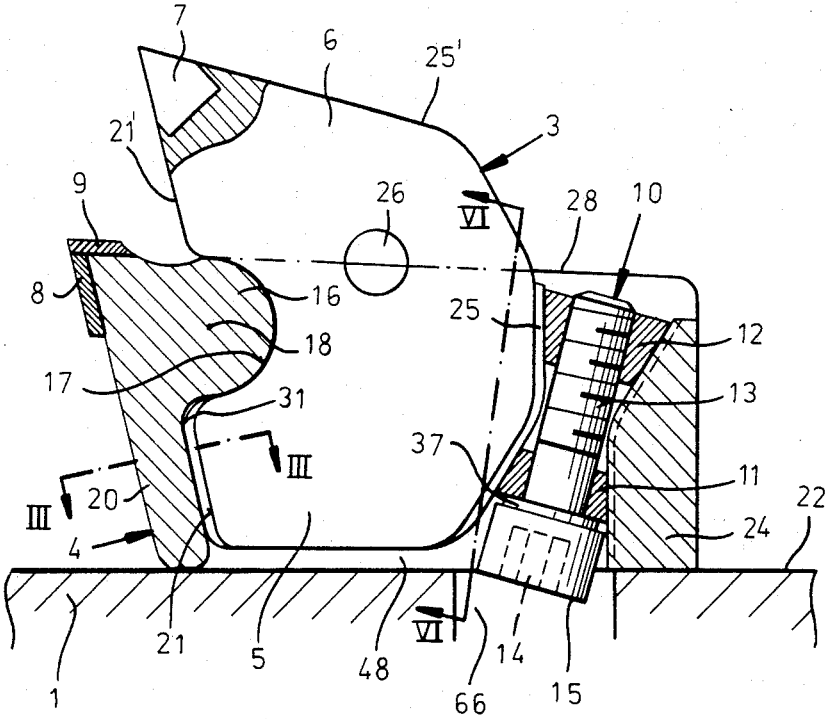
FIG. 1 is a side-elevational view, partly in section, of a combination of a tool holder and a pick embodying our invention.
Figure 2:
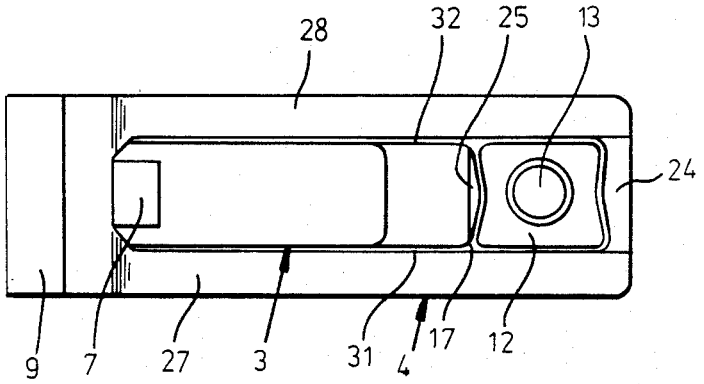
FIG. 2 is a top view of the assembly shown in FIG. 1.

In FIGS. 1–6 we have shown part of a conventional excavating head 1, rotatable about a nonillustrated axis parallel to a face 22 thereof, onto which a tool holder 4 has been welded. This tool holder is representative of a number of such holders peripherally spaced on face 22. A pick 3 of substantially rectangular cross-section, as seen in FIG. 2, has a protruding tip 6 and a concealed shank 5, the latter being inserted in a receiving pocket 77 of holder 4 bounded by wide lateral walls 47, 48 (FIG. 6) facing flat sides 31, 32 of the pick, a narrow front wall 20, and a narrow rear wall 24. While the face 22 may be substantially vertical when the machine including the excavating head 1 is operated to attack a mine face, it will be convenient for purposes of this description to consider it horizontal with the tool holder 4 positioned on top of it as seen in FIG. 1. Thus, lateral walls 47 and 48 have respective upper surfaces 27 and 28 forming part of the rim of an open end of receiving pocket 77.

With the tool holder 4 assumed to move from right to left in FIG. 1 upon rotation of excavating head 1 about its axis, tool shank 5 has a leading flank 21 and a trailing flank 25 respectively facing the front and rear walls 20 and 24 of holder 4. Leading flank 21 has an arcuate recess 17 which extends over approximately a semicircle and closely hugs a correspondingly curved convex boss 16 projecting inward from front wall 20. The convex and concave formations 16, 17 of wall 20 and flank 21 are centered on a pivotal axis 18 in line with a rearwardly offset outward continuation 21′ of flank 21. The junction of flank 21′ with a forwardly bent continuation 25′ of flank 25 defines a cutting edge of pick 3 which, in a manner well known in the art, is formed by an insert 7 of hard metal. Protective layers 8 and 9 of corundum for example, partly cover the front and top faces of wall 20 (as viewed in FIG. 1) which define what may be considered an ancillary working edge.

Trailing flank 25 is separated from rear wall 24 of holder 4 by a space accommodating a clamping unit 10 which acts as a counterbearing for the rotary joint 16, 17. Clamping unit 10 comprises a screw 13 traversing a pressure sleeve 11 and engaging a nut 12, the sleeve and the nut having trapezoidal profiles converging toward each other while resting against the correspondingly angled surfaces of trailing flank 25 and pocket wall 24. These two surfaces, accordingly, approach each other between clamping members 11 and 12, coming closest in a plane transverse to screw 13—lying substantially midway between these members—whose intersection with the plane of flank 21′ defines the pivotal axis 18. The clamping effect of members 11 and 12, urged toward each other by the screw 13, is therefore well balanced with reference to the rotary joint 16, 17 whereby that joint is fully able to absorb the pressure exerted upon it by the encounter of the cutting edge of tip 6 with the mineral matter of a mine face. Leading flank 21 is in contact with wall 30 in the clamped position of tool shank 5.

Figure 4:
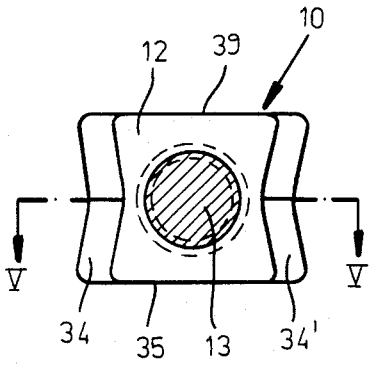
FIG. 4 is an end view of a clamping unit forming part of that assembly.

From FIGS. 2 and 4 it will be apparent that nut 12 has a butterfly-like outline whose re-entrant sides 34 and 34′ positively interfit with the coacting surfaces of flank 25 and wall 24 which are bent at corresponding obtuse angles in a transverse plane. The same applies to the interengagement of these coacting surfaces with respective sides 33, 33′ (FIG. 5) of sleeve 11. The other two sides 35, 29 (FIG. 4) of nut 12 and corresponding sides of sleeve 11 are flat and mutually parallel so as to hold these members against rotation.

Figure 5:
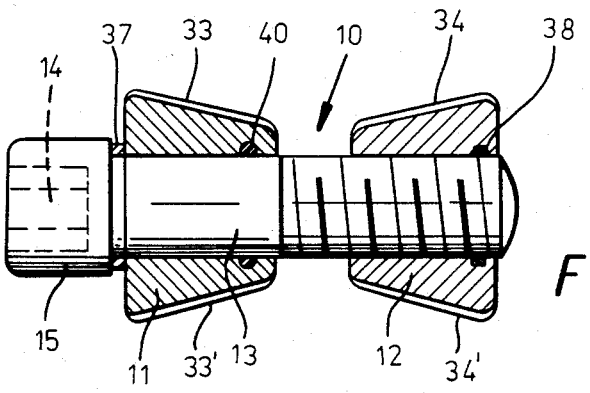
FIG. 5 is a sectional view taken on the line V—V of FIG. 4.

FIG. 5 further shows elastomeric friction rings 38 and 40 inserted in inner peripheral grooves of members 12 and 11 to prevent an untimely loosening of screw 13. To the same effect there is interposed a split ring 37 between sleeve 11 and a cylindrical bolt head 15 which has a hexagonal socket 14 engageable by an external tool through a cutout 66 in the body of excavating head 1. Bolt head 15, accordingly, is well protected from dust and debris developing at a mine face attacked by the pick 3.

Figure 3:
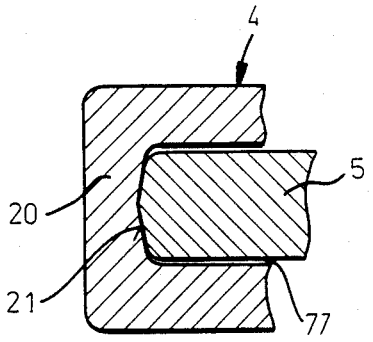
FIG. 3 is a fragmentary sectional view taken on the line III—III of FIG. 1.

As seen in FIG. 3, the leading flank 21 of tool shank 5 and the coacting inner surface of front wall 20 of holder 4 are also obtuse-angled in a transverse plane for positively centering the shank 5 in the receiving pocket 77 so as to minimize the lateral clearances into which coal or rock particles could penetrate.

Figure 6:
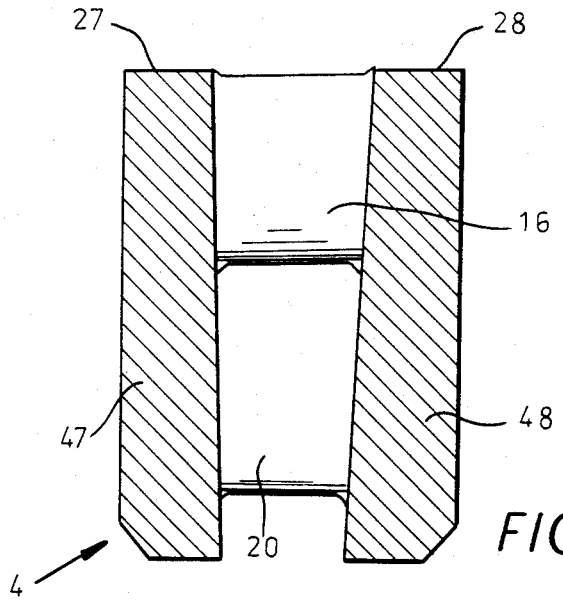
FIG. 6 is a cross-sectional view of the holder of FIGS. 1 and 2 with the associated pick removed taken on the line VI—VI of FIG. 1.

FIG. 6 shows that the inner surfaces of lateral walls 47 and 48 are not parallel in the vicinity of wall 20 but diverge toward the boss 16 to facilitate the insertion of the shank 5 of a pick 3 to be installed in holder 4. With clamping unit 10 removed, the pick can readily be introduced into the pocket 77 and then moved forward to let the boss 16 enter the recess 17 with establishment of pivotal axis 18 about which the pick can limitedly swing under pressure of sleeve 11 and clamping nut 12 when the unit 10 is tightened by the screw 13. The opposite procedure is, of course, employed for removing a worn pick 3 from the holder 4; such removal is assisted by the presence of a hole 26, lying at the level of surfaces 27 and 28 (as known per se from German utility model No. 78 23 740 referred to above), by the introduction of a bar into that hole with purchase on surface 27 or 28 to help pry the pick loose from its holder. The hole 26 can also be used for stringing several picks together as spare tools ready for insertion into a vacant holder.

Figure 7:
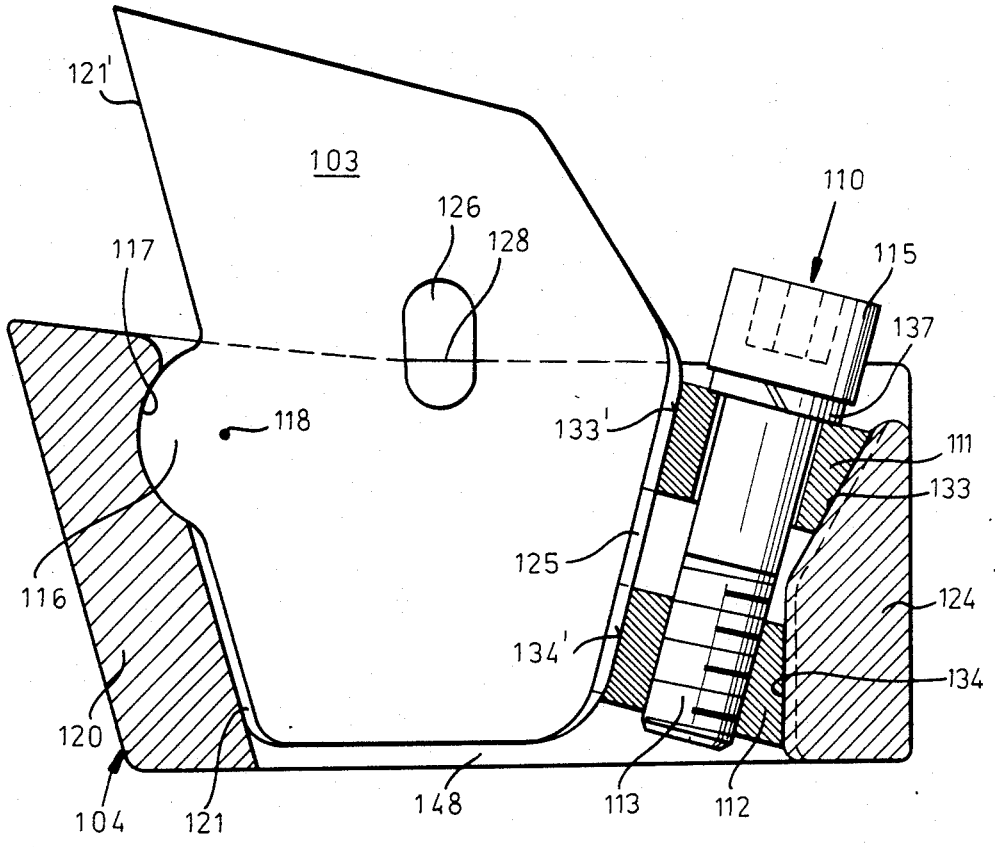
FIG. 7 is a view similar to that of FIG. 1, showing a modification.

In FIG. 7, where elements corresponding to those of FIGS. 1–6 have been given the same reference numerals preceded by a "1" in the position of the hundreds digit, the leading flank 121 of the shank of pick 103 has an arcuate bulge or boss 116 coacting with a complementary recess 117 in front wall 120 of holder 104; the curvatures of formations 116 and 117 are centered on a pivotal axis 118 which again lies at the intersection of the plane of leading flank 121' with a plane transverse to screw 113 extending substantially midway between pressure sleeve 111 and nut 112. The two cylindrical curvatures extend in this case over an arc only slightly larger than 90° . The clamping unit 110 is also inverted, with reference to unit 10 of the preceding embodiment, so that its bolt head 115 is accessible from the top as viewed in FIG. 7. Furthermore, the profiles of members 111 and 112 have been modified so that the side 133' of sleeve 111 forms two angularly adjoining faces coplanar with corresponding faces of the side 134' of nut 112, with the opposite sides 133 and 134 still converging toward the screw axis in the direction of the aforementioned transverse midplane. The interfitting of members 111 and 112 with the coacting surfaces of rear wall 124 and trailing flank 125 is otherwise the same as in the assembly of FIGS. 1–6.

In principle, the inverted rotary joint of FIG. 7 could also be used in the preceding embodiment—as well as in other embodiments described hereinafter—although it would require an enlargement of the front wall of the tool holder and thus of the overall dimensions of the assembly.

Figure 8:
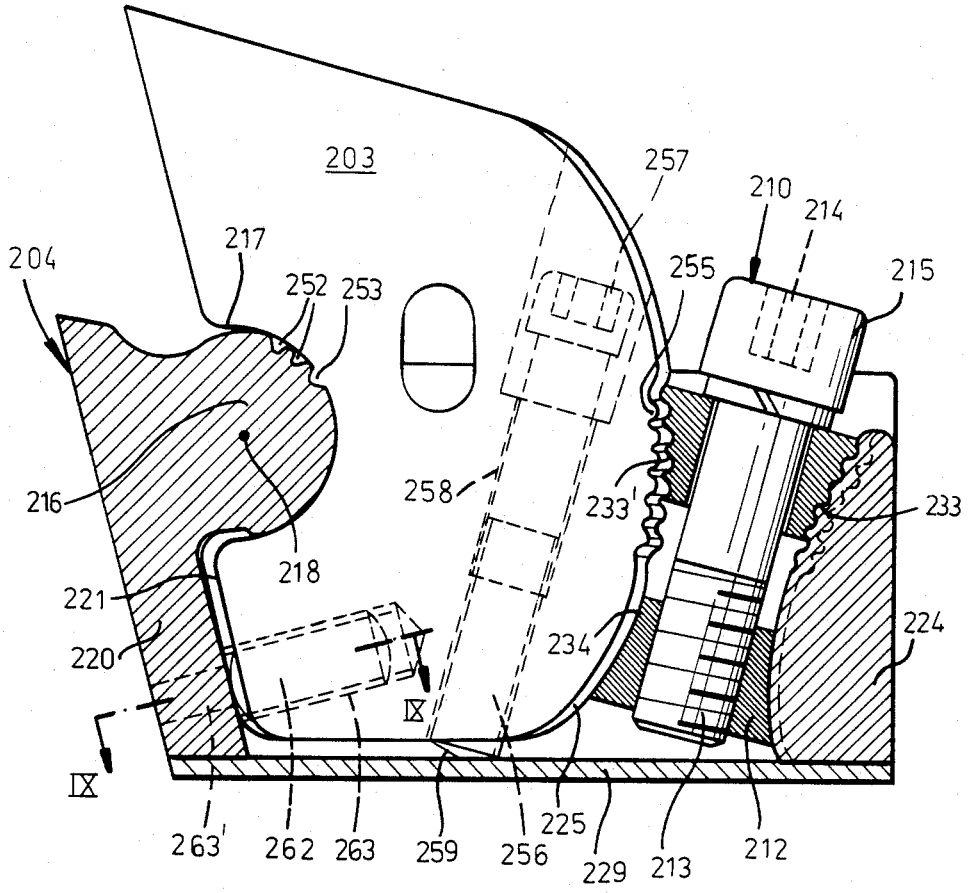
FIG. 8 is another view similar to that of FIG. 1, illustrating a further embodiment.

In FIG. 8, where elements analogous to those already described are given corresponding reference numerals with a "2" in the position of the hundreds digit, the rotary joint between the front wall 220 of holder 204 and the leading flank 221 of pick 203 differs from that shown in FIG. 1 in that a tooth 253 projecting from recess 217 is selectively receivable in any of several indentations 252 of boss 216 whereby pick 203 can occupy one of several angular positions relative to holder 204. The inner surface of rear wall 224 and the trailing flank 225 of pick 203 have similarly spaced indentations 254 and 255 matingly engageable by the correspondingly ribbed surfaces 233 and 233' of sleeve 211.

Figure 9:
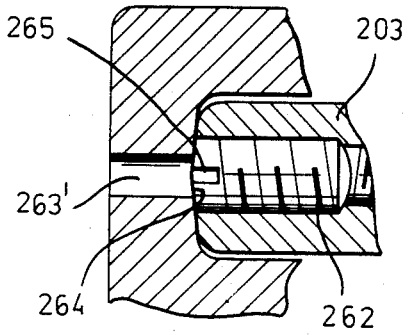
FIG. 9 is a fragmentary sectional view taken on the line IX—IX of FIG. 8.

For the additional stabilization of pick 203 in holder 204, its shank may be provided with one or more threaded bores 258, 263 engaged by ancillary screws 256 and 262 respectively bracing that shank against a bottom wall 229 of holder 204 and against its front wall 220. Screw 256, resting with its end 259 against bottom wall 229, has a head 257 which preferably is cylindrical like the bolt head 215 of clamping screw 213 and has a hexagonal recess advantageously engageable by the same implement (e.g. an Allen wrench) that fits into the recess 214 of bolt head 215. An end face 264 of screw 262, provided with a slot 265 engageable by a screwdriver as seen in FIG. 9, abuts the inner surface of wall 220 which has an access hole 263' substantially in line with bore 263.

In the embodiment illustrated in FIG. 8, bore 258 is so oriented that screw 256 is parallel to screw 213 in the illustrated limiting position of pick 203 in which its leading flank 221 comes to rest against wall 220. In that limiting position, furthermore, screw 262 includes with screw 213 an angle which may range between about 110° and 140° and preferably is close to 120° . It will be understood, however, that either of these ancillary screws can be used alone and that one or both of them can also be employed in the absence of indexing formations 252–255. Moreover, the end 259 of screw 256 could bear directly upon the holder-supporting face of the excavating head with omission of bottom plate 229; conversely, such a bottom plate forming part of the holder can also be provided with other embodiments in order to prevent an overloading of the welding seams between the holder and the excavating head by the stresses exerted upon the clamping unit.

Figure 10:
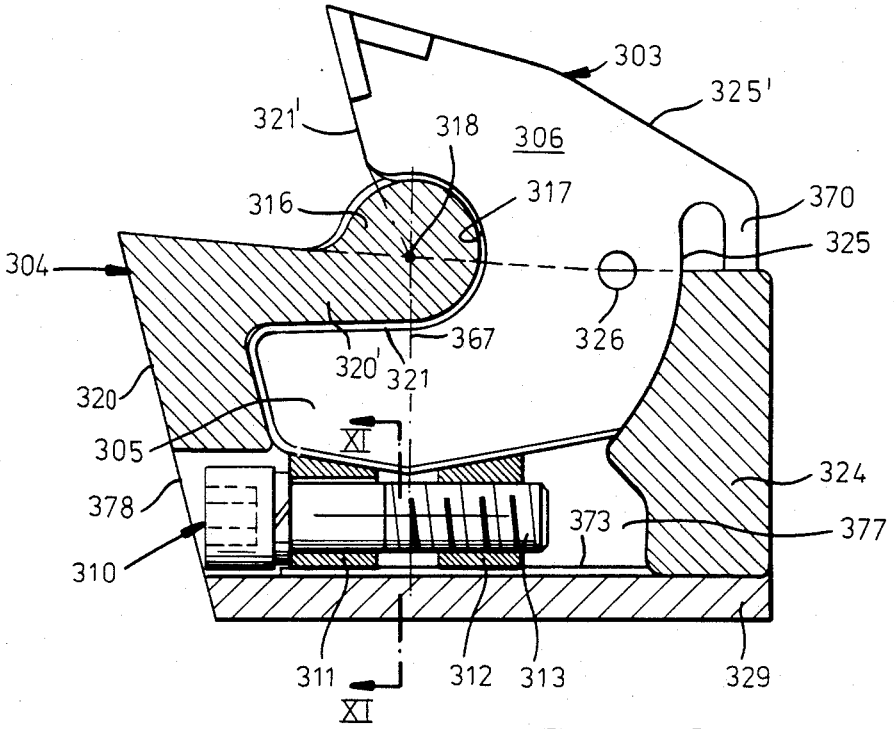
FIG. 10 is a further view similar to that of FIG. 1, illustrating yet another embodiment.
Figure 11:
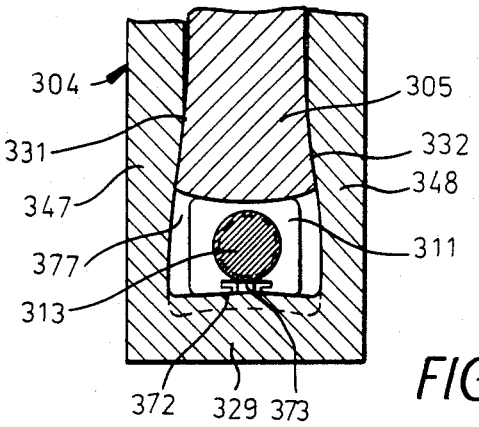
FIG. 11 is a fragmentary sectional view taken on the line XI—XI of FIG. 10.

In FIGS. 10 and 11 we have used the same references as before, but with a "3" in the position of the hundreds digit, to designate analogous components. As shown in FIG. 10, the holder 304 has been lengthened with reference to pick 303 so as to provide an overhang 320', integral with its front wall 320, against which the leading flank 321 of tool shank 305 comes to rest in the insertion position of the pick. In that insertion position, moreover, a spur 370 at the junction of trailing flank 325 with its extension 325' bears from above onto the upper surface of rear wall 324. Clamping unit 310 is now disposed in the lower part of the receiving pocket 377 where its pressure sleeve 311 and nut 312 are wedged between the underside of the tail end of shank 305 and the bottom wall 329 bounding the pocket 377. Bottom wall 329, moreover, is shown provided with a rib 373 (see also FIG. 11) parallel to the axis of screw 313 which fits into a guide groove 372 of nut 312 and a similar guide groove of pressure sleeve 311. Front wall 320 has an aperture 378 giving access to pocket 377.

FIG. 11 further shows that sides 331, 332 of tool shank 305 and the adjoining inner surfaces of lateral walls 347, 348 converge toward the open end of pocket 377 along the lower part of that pocket and in the region of a transverse midplane 367 whose intersection with the plane of leading flank 321' defines the pivotal axis 318 of rotary joint 316, 317. This upward convergence, which contrasts with the divergence shown in FIG. 6, is made possible by the fact that the shank 305 swings inward by a rotation through almost 90° about pivotal axis 318 instead of being lowered into the receiving pocket and then moved forward as in the preceding instances. Flank 325 is curved about axis 318 so as to be in contact with the similarly curved inner surface of wall 324 during such rotation. It will also be noted that the obtuse angle enabling a positive interfitting between the tool shank and the front wall of the holder—as described above with reference to FIG. 3—is here continued past recess 317 and boss 316 so as to insure a proper centering of the projecting tip 306 of pick 303.

Figure 12:
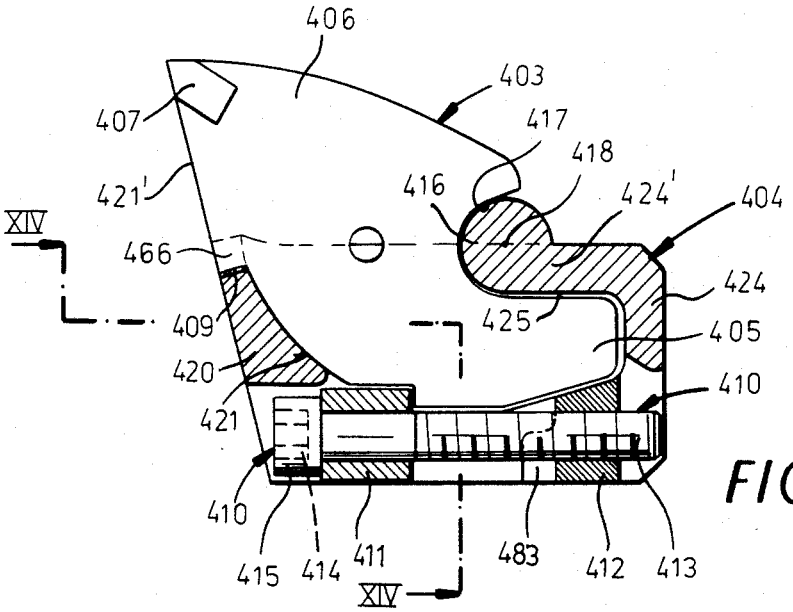
FIG. 12 is still another view similar to that of FIG. 1, illustrating yet a further embodiment.
Figure 13:
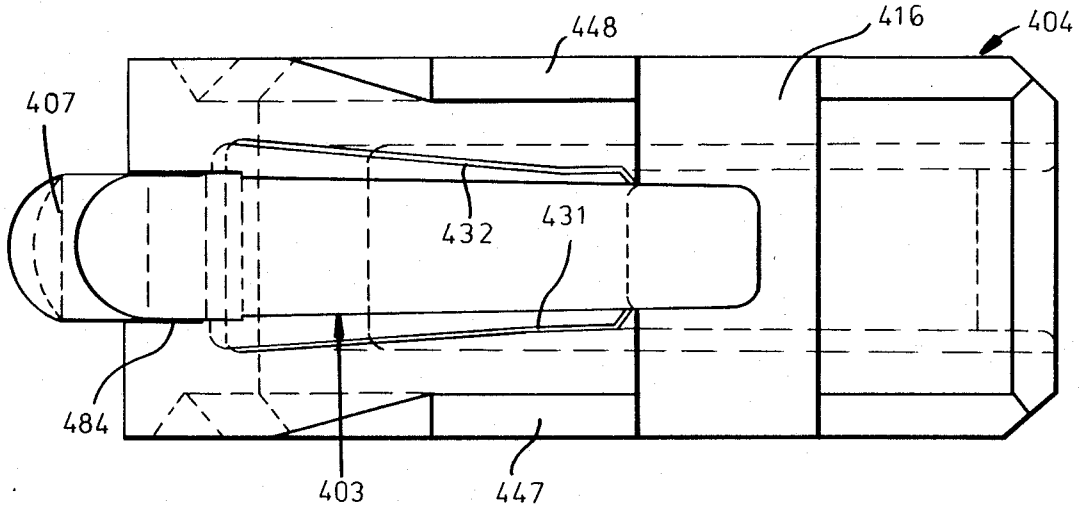
FIG. 13 is a top view of the assembly of FIG. 12.
Figure 14:
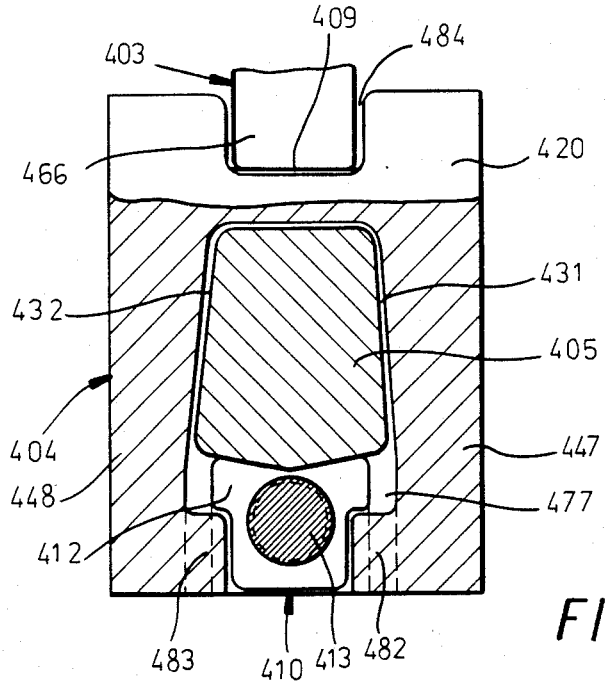
FIG. 14 is a fragmentary sectional view taken on the line XIV—XIV of FIG. 12.

The embodiments shown in FIGS. 12–14, in which elements having counterparts in the preceding Figures have been designated by the same reference numerals with a "4" in the position of the hundreds digit, differs from those described above in that the rotary joint is formed by a boss 416 projecting inward from rear wall 424 and by a complementary recess 417 in the trailing flank 425 of pick 403. Wall 424 is here provided with an overhang 424' against which the flank 425 comes to rest in the insertion position.

The surface area of pick 403 engageable by clamping unit 410 is provided in this instance with a shoulder 480 abutted by the pressure sleeve 411 when the screw 413 is tightened to force the nut 412 into firm contact with the tail of shank 405. As seen in FIG. 14, nut 412 is laterally recessed to coact with a pair of confronting shoulders 482, 483 of walls 447, 448 preventing the nut from rotating prior to the insertion of shank 405. The inner surfaces of lateral walls 447, 448 and the adjoining sides 431, 432 of shank 405 converge upward, as do their counterparts in FIG. 11, toward the open end of receiving pocket 477.

As will be apparent from FIG. 12, the leading flank 421 of shank 405 is curved about pivotal axis 418 in a manner analogous to that described for the trailing flank 325 of FIG. 10. The front wall 420 of tool holder 404 has a depression 484 which is lined with a corundum layer 409 and in which a spur 466 of the leading flank 421' of tip 406 comes to rest.

Figure 15:
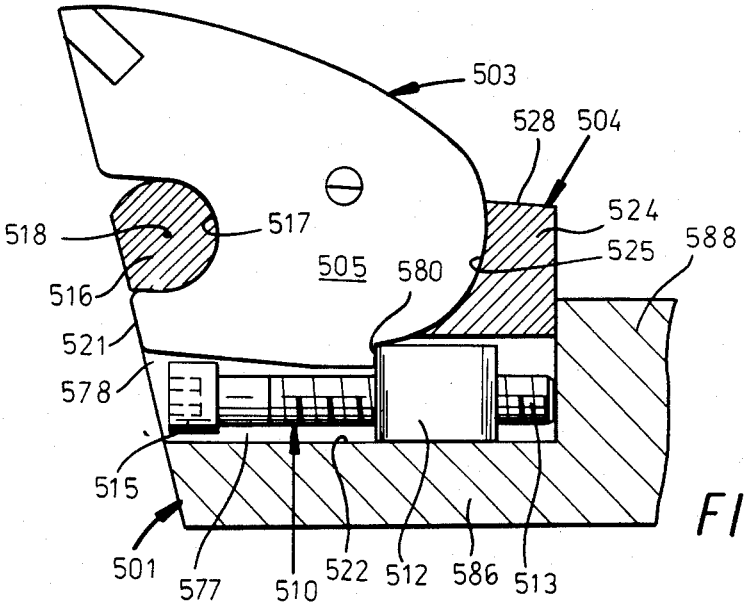
FIG. 15 is a view similar to that of FIG. 12, illustrating another modification.

FIG. 15, in which elements already described bear the same reference numerals as before except for a "5" in the position of the hundreds digit, shows an arrangement generally similar to that of FIG. 10 wherein, however, the pressure sleeve of the preceding embodiments has been omitted. Tool holder 504 is here disposed with its rear wall 524 abutting a step 588 of excavating head 501 which has a face plate 586 bounding the receiving pocket 577 at its bottom. Nut 512 also engages a shoulder 580 on the underside of shank 505 whose trailing flank 525 is curved but not centered on the pivotal axis 518 of rotary joint 516, 517 so that the correspondingly curved inner surface of wall 524 forms an abutment for pick 503. With the front wall of holder 504 reduced to a transverse rung forming the boss 516, pocket 577 is open at a forward end 578 giving access to bolt head 515.

Figure 17:
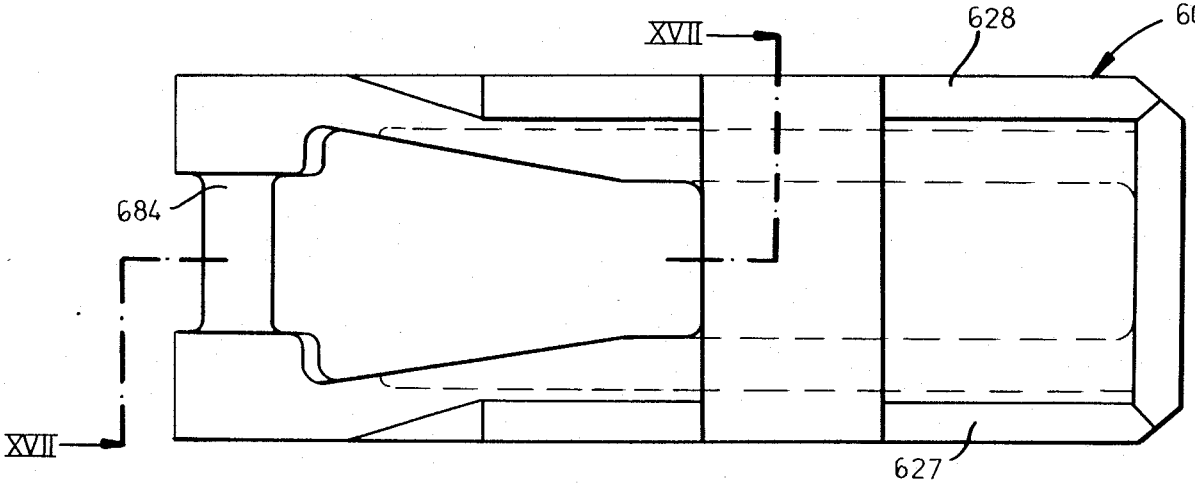
FIG. 17 is a top view of the tool holder illustrated in FIG. 16.
Figure 18:
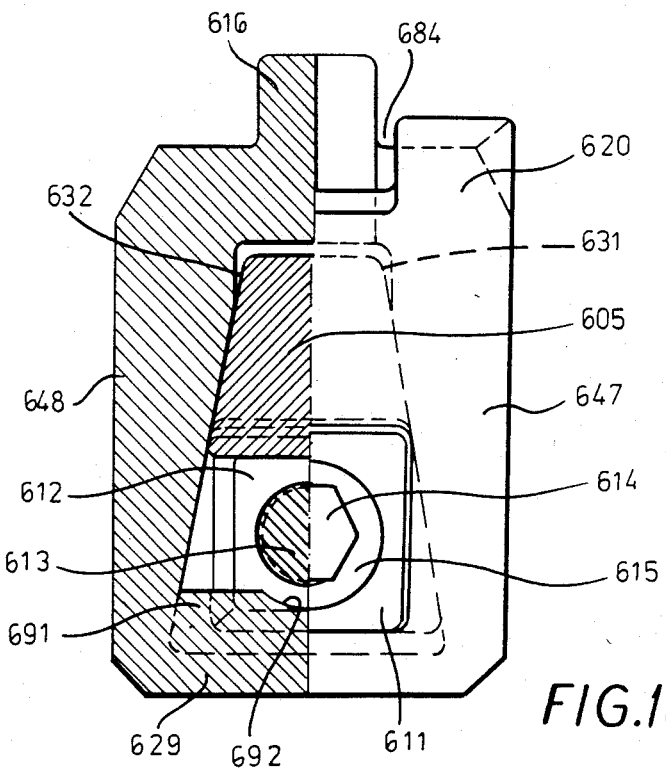
FIG. 18 is an end view, partly in section, taken on the line XVIII—XVIII of FIG. 17.
Figure 16:
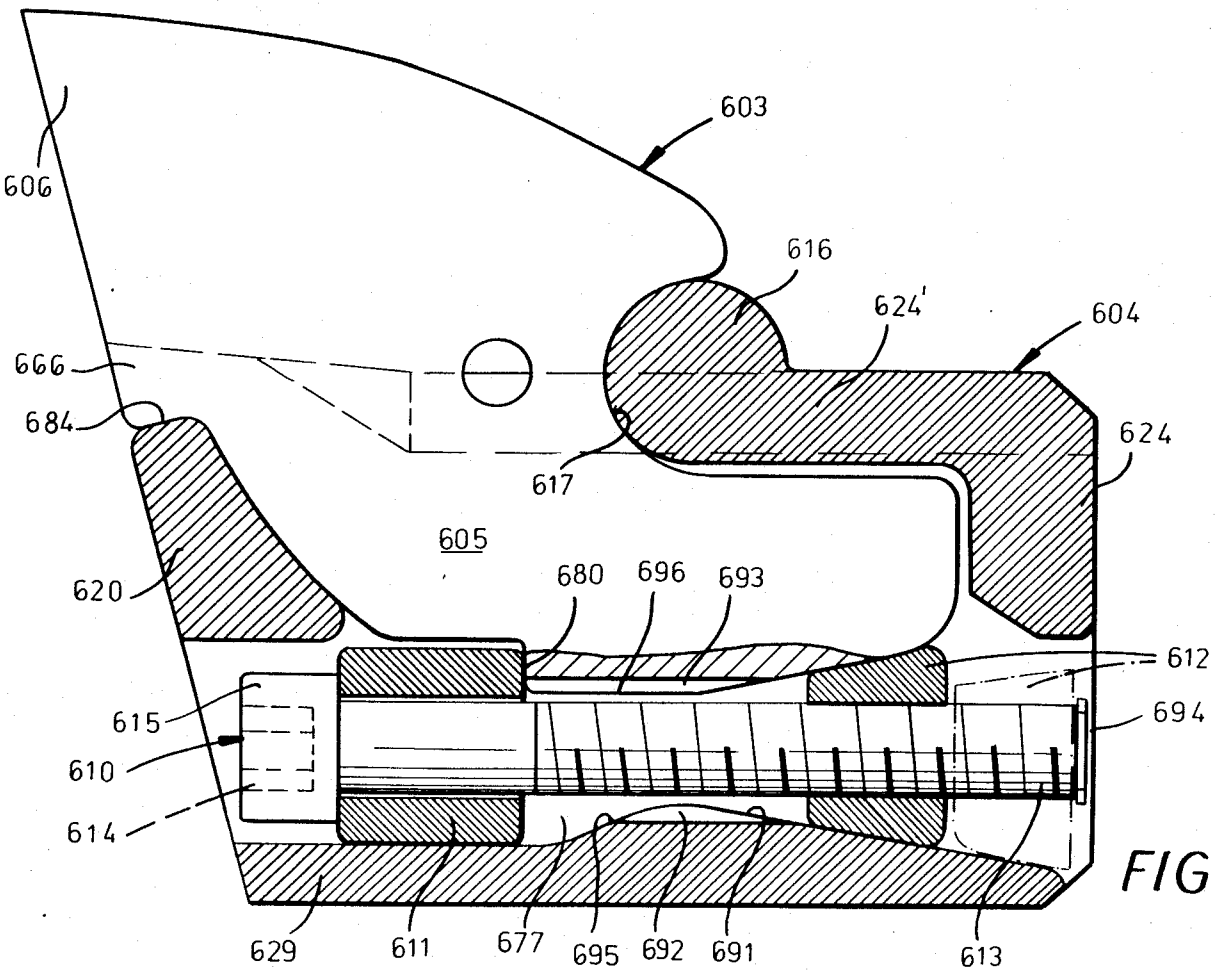
FIG. 16 is another view similar to that of FIG. 12, showing a further modification.

In FIGS. 16–18 we have illustrated an assembly similar to that of FIGS. 12–14, with corresponding elements designated by the same references except for a "6" in the position of the hundreds digit. The end of screw 613 opposite bolt head 615 is here shown peened over at 694 to prevent a loss of nut 612; this nut, however, can be removed sufficiently far from bolt head 615 and pressure sleeve 611 to let that sleeve disengage the shoulder 680 of tool shank 605 for the purpose of releasing the pick 603. This release is facilitated by the fact that a bottom plate 629 of holder 604, which forms a ramp 695 leading into a sloping face 691 engaged by nut 612, has a central depression 692 accommodating the screw 613 in a tilted position thereof in which the nut 612 has been moved into contact with the peened-over end 694. Additional mobility for the clamping unit 610 is provided by a similar indentation 693 at the underside of shank 605.

As will be apparent from FIG. 18, lateral walls 647, 648 of holder 604 and the adjoining sides 631, 632 of tool shank 605 converge toward the open end of pocket 677 in a manner similar to that illustrated for their counterparts in FIG. 14.

The peening-over of the end of screw 613 will be unnecessary if the holder 604 is bounded by a step of the associated excavating head in the manner illustrated for holder 504 in FIG. 15.

The angles included between the sloping sides of clamping members 11, 12 etc. and the corresponding screw axis preferably are on the order of 10°. These members, and especially the clamping nut, could also be of frustoconical shape in some instances.

We claim:

1. In combination, a tool holder carried on a rotary excavating head and a pick removably received in a pocket of said tool holder, said pick having a tip protruding from an open end of said pocket and further having a shank with a leading flank and a trailing flank and with two generally flat sides, said pocket having two narrower walls confronting said flanks and two wider walls confronting said sides, said leading flank being provided with a concave arcuate indentation of substantially semicircular profile and the confronting one of said narrower walls of said pocket being provided with a correspondingly curved convex boss defining a rotary joint with said indentation which extends over an arc between 90° and 180° and is cetered on a pivot axis perpendicular to said sides near the level of said open end, said narrower walls being spaced apart sufficiently to let said shank swing relatively to said tool holder about said pivot axis, and screw-threaded counterbearing means in said pocket accessible from outside said tool holder for engagement with a surface area of said shank remote from said pivot axis to lock said shank in an inserted position, said surface area of said shank remote from said pivot axis comprising a convex portion of said trailing flank which confronts a convex portion of the other narrow wall of said pocket, said counterbearing means comprises a nut engaging said convex portions on one side of a region of closest approach of said convex portions, a clamping screw threadedly engaging said nut and located between said portions, and a pressure sleeve drawn by said screw toward said nut and engaging said convex portions on an opposite side of said region of closest approach.

2. The combination defined in claim 1 wherein said clamping screw has a bolt head engageable by an external implement and bearing upon said sleeve.

3. The combination defined in claim 1 wherein said nut and said pressure sleeve have outer surfaces converging toward each other.

4. The combination defined in claim 3 wherein said remote surface area is divided into two portions generally adjoining each other at an obtuse angle, said portions being respectively in contact with said nut and with said pressure sleeve.

5. The combination defined in claim 1 wherein said leading flank and said front wall are provided with interfitting profiles centering said shank in said pocket.

6. The combination defined in claim 1 wherein said clamping screw is provided opposite said bolt head with a peened-over free end preventing disengagement of said nut therefrom.

7. The combination defined in claim 1 wherein said boss and indentation are complementarily toothed and indented for enabling a selective interfitting thereof in a plurality of different relative angular positions.

8. The combination defined in claim 1 wherein said pressure sleeve and the convex portions engaged thereby have mutually complementary indentations selectively engageable with each other in a plurality of different relative angular positions.

9. The combination defined in claim 1 wherein said counterbearing means further comprises an ancillary screw engaging a threaded bore of said shank and bearing endwise upon a boundary of said pocket.

CUTTING-TOOL MOUNTING FOR ROTARY EXCAVATING HEAD

FIELD OF THE INVENTION

Our present invention relates to a rotary excavating head, e.g. as used in coal mining, having tool holders for the support of respective cutting tools or picks peripherally distributed thereon for the purpose of chipping away at a mine face as the excavating head advances along its axis of rotation.

BACKGROUND OF THE INVENTION

In order to facilitate the replacement of worn or broken picks, each pick must be removably fitted into a receiving pocket of the associated holder within which it is locked in position by suitable fastening means. The removal of a pick from its pocket is sometimes made difficult by the settling of comminuted matter, such as coal or rock particles, in the narrow clearances necessarily present between the inserted part of the pick—referred to hereinafter as its shank—and the adjacent walls of the receiving pocket. Such penetration of solid particles will occur even if, as is customary, the excavating head is provided with nozzles through which water is emitted in order to precipitate the evolving dust. Thus, forces exerted upon the tool shank not only during cutting but also during extraction of the pick from its holder may deform the holder itself unless care is taken to insure an optimum mode of seating the shank in its pocket and holding it in position.

German utility model No. 78 23 740 discloses a holder for a pick with an outline in the form of an equilateral triangle allowing any one of its three corners to be used as a working edge of its projecting tip while another corner forms part of a shank projecting into the holder pocket. The shank is held in place by a bolt passing through frustoconical sleeves which converge toward each other and are clamped between the bolt head and a nut, the sleeves bearing upon two trapezoidal wedge pieces respectively lying against a trailing flank of the pick and a confronting rear wall of the pocket. The retaining effect of such a clamp is somewhat uncertain on account of the large angle of divergence (60°) of the leading and trailing flanks of the shank and in view of the absence of any positive-acting abutment.

Another arrangement for releasably retaining a pick in an associated tool holder is shown in German utility model No. 81 16 945.0. According to that arrangement, the trailing flank of the tool shank has a spur underreaching a shoulder at the back of the pocket while its leading flank has a concave surface separated by an arcuate gap from a convex surface of a transverse web spanning the sidewalls of the pocket; the two surfaces are curved about different axes so that the gap converges. A similarly converging arcuate wedge piece is forced into the gap and terminates in a bifurcation whose prongs have ends bent around the web to hold the wedge piece in place. Since an extraction of the pick requires an unbending of the prong ends which upon a subsequent rebending would have lost some of their holding strength, not only the pick but also the wedge piece will have to be replaced; also, the bending and unbending operations are difficult to perform underground and the need for having spare wedge pieces available is an inconvenience.

Aside from the necessity of replacing worn picks, it is sometimes desirable to change the angle of attack of a still usable pick which requires a repositioning thereof in its pocket. Such a repositioning is not possible with the arrangement last described; while the triangular pick of the first-mentioned German utility model has three possible positions, the angle of attack remains the same in all instances.

OBJECTS OF THE INVENTION

The general object of our present invention is to provide improved means for seating and retaining the shank of a pick in the pocket of an associated tool holder with minimization of the problems of insertion and extraction.

A more particular object is to provide means in such a tool holder for enabling the positioning of the pick at slightly different angles of attack.

SUMMARY OF THE INVENTION

In accordance with our present invention, the shank of a pick with leading and trailing flanks (as viewed in the direction of rotation of an excavating head carrying the tool holder) and with two generally flat sides is received in a pocket having two narrower walls confronting its flanks and two wider walls confronting its sides, one of the flanks and the confronting wall being provided with mutually complementary arcuate formations defining a rotary joint that extends over an arc between 90° and 180° and is centered on a pivotal axis perpendicular to the shank sides near the level of the open end of the pocket through which the tip of the pick protrudes. The two narrower walls of the pocket are spaced apart sufficiently to let the shank swing relatively to the tool holder about that pivotal axis while a surface area of the shank remote from the pivotal axis is engaged by screw-threaded counterbearing means in the pocket, accessible from outside the tool holder, to lock the shank in an inserted position.

According to a more particular feature of our invention, the counterbearing means comprises a clamping screw with a bolt head engageable by an external implement and a nut coacting with the remote surface area of the shank, rather than with an interposed wedge piece of the type used in the aforementioned German utility model No. 78 23 740. The clamping screw may also pass through a presure sleeve, located between the bolt head and the nut, for exerting additional stress upon the remote surface area while serving as an abutment for the bolt head. Alternatively, the clamping screw may bear endwise upon a pocket boundary, e.g. upon a step of the excavating head forming such a boundary.

Pursuant to another advantageous feature of our invention, the arcuate formations referred to may be complementarily toothed and indented for enabling a selective interfitting in a plurality of different relative angular positions. Such different positions can also be selectively established with the aid of similar mutually complementary indentations of the pressure sleeve and the remote surface area engaged thereby.

Moreover, the counterbearing means according to our invention may further comprise bracing means in the form of one or more ancillary screws engaging a threaded bore of the shank and bearing endwise upon a boundary of the pocket.